US009623933B2

(12) United States Patent
Orr

(10) Patent No.: US 9,623,933 B2
(45) Date of Patent: Apr. 18, 2017

(54) BOAT HULL WITH A PIVOTALLY MOUNTED HYDRODYNAMIC APPENDAGE

(71) Applicant: Anthony Hugh Orr, Kingsbridge (GB)

(72) Inventor: Anthony Hugh Orr, Kingsbridge (GB)

( * ) Notice: Subject to any disclaimer, the term of this patent is extended or adjusted under 35 U.S.C. 154(b) by 0 days.

(21) Appl. No.: 14/392,401

(22) PCT Filed: Jun. 13, 2014

(86) PCT No.: PCT/IB2014/003273

§ 371 (c)(1),
(2) Date: May 12, 2016

(87) PCT Pub. No.: WO2015/150858

PCT Pub. Date: Oct. 8, 2015

(65) Prior Publication Data

US 2017/0015386 A1 Jan. 19, 2017

(30) Foreign Application Priority Data

Jun. 26, 2013 (GB) ..... 1311419.4

(51) Int. Cl.
*B63B 1/24* (2006.01)
*B63B 1/22* (2006.01)
*B63B 1/12* (2006.01)

(52) U.S. Cl.
CPC ..... *B63B 1/22* (2013.01); *B63B 1/125* (2013.01)

(58) Field of Classification Search
CPC ..... B63B 1/22; B63B 1/125
See application file for complete search history.

(56) References Cited

U.S. PATENT DOCUMENTS 2,265,206 A * 12/1941 Stampfi ..... B63B 1/22 114/287
2,363,421 A * 11/1944 Huard ..... B63B 1/22 114/126
4,458,622 A * 7/1984 Anderson ..... B63B 1/04 114/284
5,383,419 A * 1/1995 Stevens ..... B63B 39/061 114/286
5,390,623 A * 2/1995 Mackaness ..... B63B 1/22 114/282

(Continued)

FOREIGN PATENT DOCUMENTS

DE 29716415 U1 * 2/1998 ..... B63B 1/22
GB 2313344 A * 11/1997 ..... B63B 1/18
NL WO 9824684 A1 * 6/1998 ..... B63B 1/22

*Primary Examiner* — Stephen Avila

(57) ABSTRACT

A boat hull with port and starboard side walls that are vertical in cross section while the bottom of the hull immediately prior to the commencement of the stern part thereafter is horizontal in cross section. Extending throughout the buoyant hulls stem part a longitudinally rectangular flat plate with port and starboard upwardly extending side walls, one each side, are located throughout the length of the vessels stem part. An upwardly directed second rectangular flat plate is arranged fore/aft extends midway between the afore ¬ side walls to a height in excess of the side walls. This upstanding plate butts its lowermost edge onto the mid-line of the first plate. Linking the forward edge of the longitudinally rectangular plate to the buoyant hull at its aftmost and deepest point are hinges.

3 Claims, 5 Drawing Sheets

(56) References Cited

U.S. PATENT DOCUMENTS

| | | | | |
|---|---|---|---|---|
| 6,684,807 | B1 * | 2/2004 | Smith | B63B 1/22 114/285 |
| 2014/0190387 | A1 * | 7/2014 | Snow | B63B 1/22 114/285 |

* cited by examiner

BOAT HULL WITH A PIVOTALLY MOUNTED HYDRODYNAMIC APPENDAGE

BACKGROUND

This invention relates to a displacement boat hull of power or sail propulsion.

It is well known that displacement vessels develop considerable resistance to forward movement as their speed exceeds $1.5\times\sqrt{\text{thewaterline}}$ of the vessel in feet.

Planing vessels avoid this barrier, being able to achieve considerably higher speeds in excess of waterline.

Planing vessels must conform to known requirements of Brake Horse Power (BHP) and total weight of vessel, combined with the correct angle of trim when under-way.

With displacement vessels a considerably improved performance would result from breaking the link between the wave making and the waterline length of vessel. To sever this connection, whilst retaining the low speed propulsive efficiency enjoyed by conventional displacement hulls at speeds below $1.2\times\sqrt{\text{length}}$ waterline lengths in feet are sought. A solution to the problem outlined is presented in the following pages with reference to the accompanying drawings.

In a displacement hull forward of the commencement of the stern part of the vessel is of no difference to other vessels aftwardly of that point the stern of the hulls reduce substantially in its underwater volume aftwardly.

SUMMARY OF THE INVENTION

A boat hull comprising a bottom having a flat mid-section and an angled stern section that reduces in draft towards the stern of the boat, wherein a hydrodynamic appendage comprising a first flat rectangular plate is hingedly attached to the hull at the transition between the mid section and the stern section and extends towards the stern, the appendage has side walls extending upwardly from the first plate and an upwardly directed second rectangular flat plate arranged along a fore/aft axis of the first plate midway between the side walls to a height in excess of the said side walls, the second plate locating within an open slot casing that extends within the boat hull, wherein means are provided to rase and lower the hydrodynamic appendage, to pivotally move the first plate towards and away from the stern section.

MODE OF OPERATION

At the commencement of operation the adjustable plate of the invention is inclined aftwardly upward to its maximum inclination.

Forward hull movement is commenced, as the speed rises bow-up trim becomes evident. Slowly the afore said plate device comes into action, thereby reducing its aftwardly upward inclination.

A lowering of the transverse stern wave becomes evident. Simultaneously the stern of the vessel will lift upwards as the afore-said procedure is repeated. This change of buoyancy will need counter-acting. Filling a suitable container with water to counter-act the new but false buoyancy of the stern part. This procedure is ongoing throughout a voyage. It sounds repetitive and intrusive but in reality not more so than many other duties.

When required the reverse procedure will be under-taken. Manual operation can over-ride automatic if necessary.

To compensate for the increase in buoyancy, automatic flooding tanks for ballast water are necessary. The ballast water pumping system may be manual or otherwise

ADVANTAGES

A vessel fitted with the adjustable stern part that is the invention can adapt its overall shape according to the prevailing sea conditions.

Waves generated by the said stern part of the vessel will be considerably reduced in amplitude compared to those waves produced by a conventional displacement vessel of similar weight, length and beam.

The adaptable stern part of the vessel described allows the vessel to reduce fuel consumption or to operate at a higher speed for the same fuel outlay.

This is a frontal view

Figure 1:
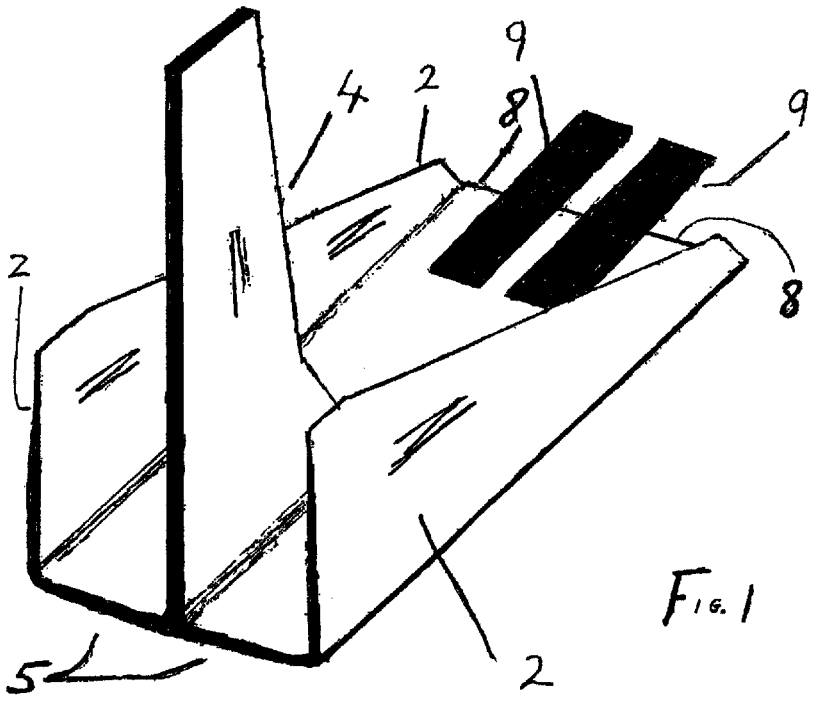
FIG. 1 shows an isometric view of all pivotally moveable hydrodynamic appendage removed from the vessel, the upstanding combination plate with port and starboard side walls, extending hinges to thereby link the forward edge of the combination plate to the lowermost trailing edge of the buoyant hull.
Figure 2:
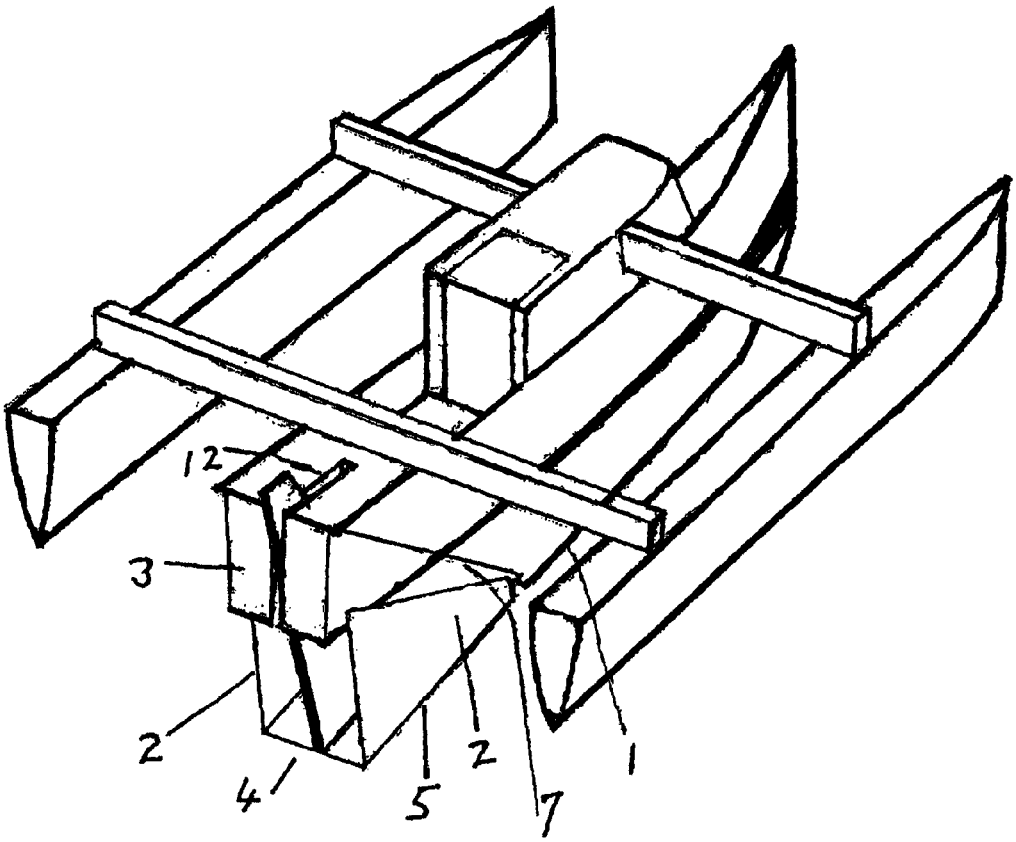
FIG. 2 shows an isometric view of the invention attached to the central hull of a multi hull vessel.
Figure 3:
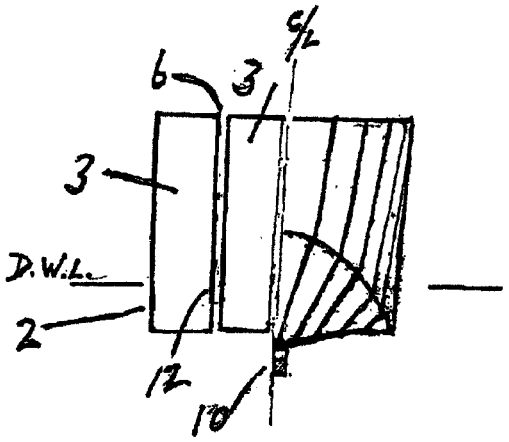
FIG. 3 A vessel to comprise at least one hull that in its stern part is longitudinally divided into sections parallel with the fore/aft axis of vessel.
Figure 4:
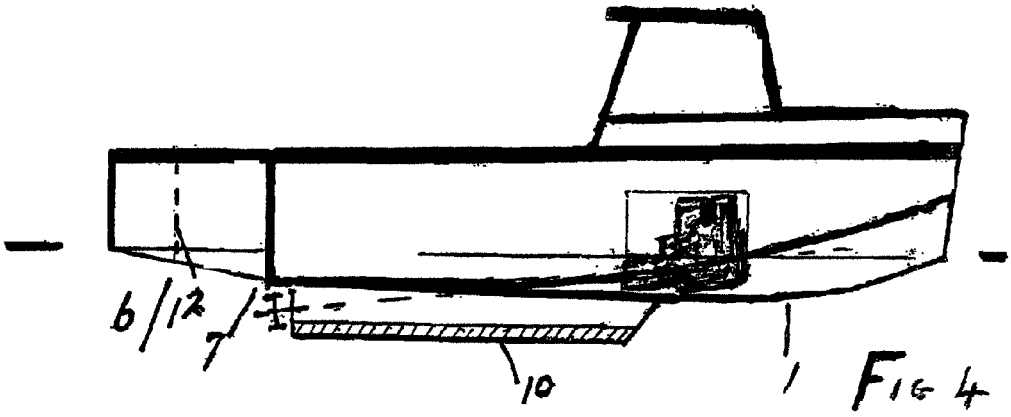

FIG. 4 is a side view

Figure 5:
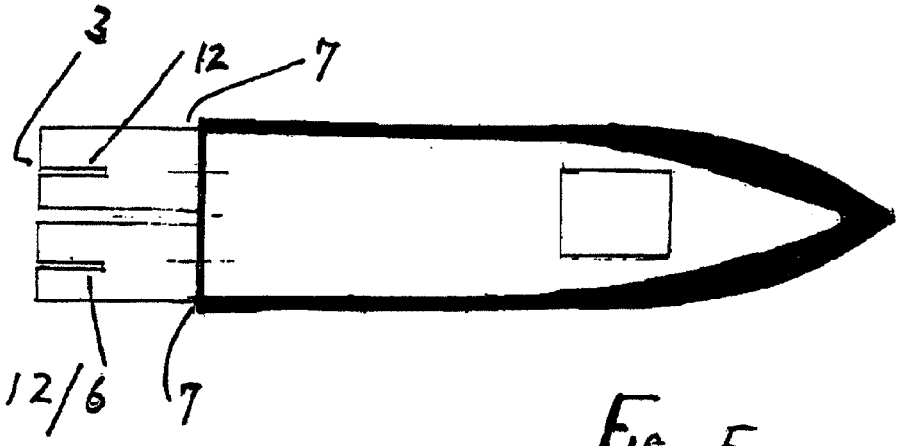

FIG. 5 is a plan view

Figure 6:
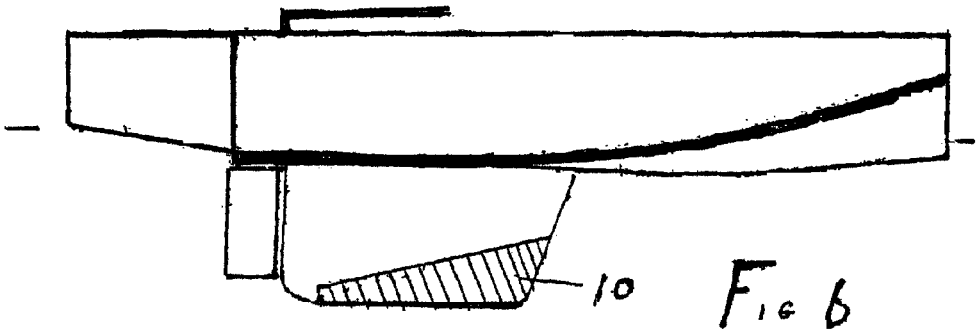
Figure 7:
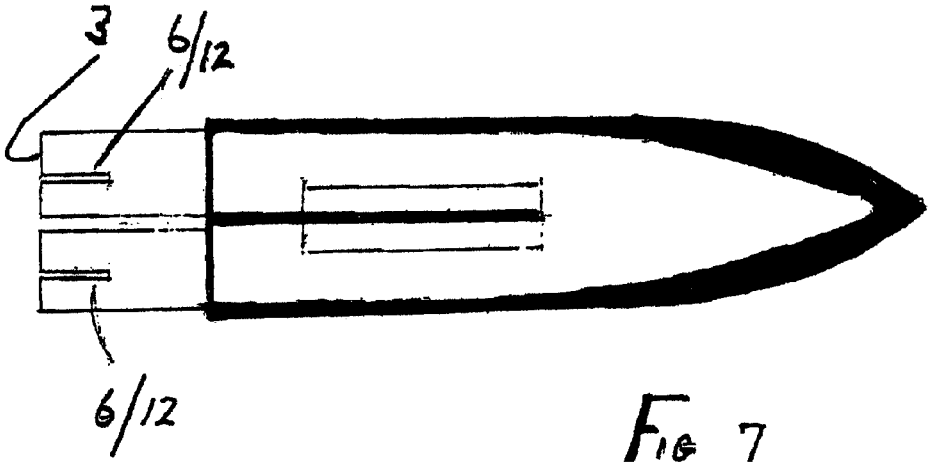
Figure 8:
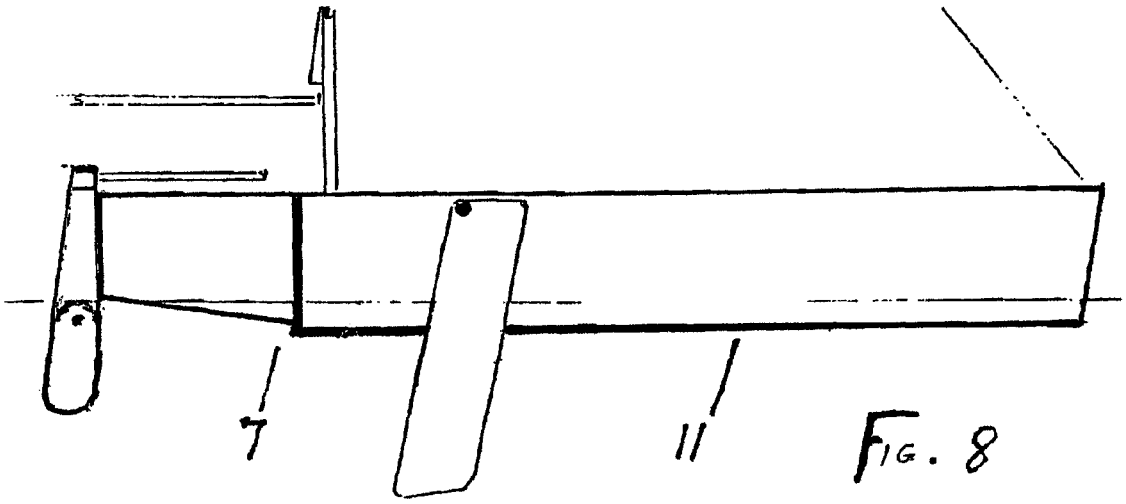
Figure 9:
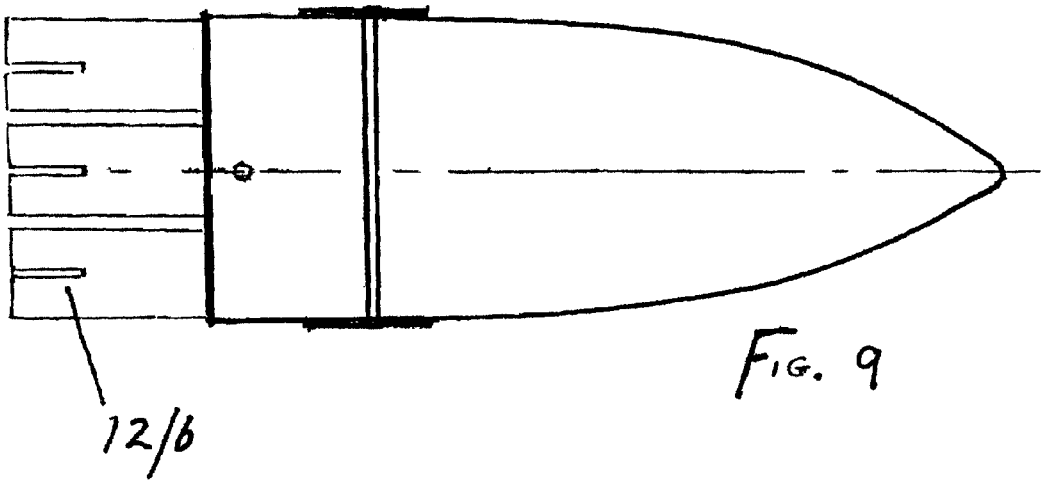

FIG. 6 shows a side view of a single hull vessel according to the invention that has a ballast keel located on the fore/aft central line of the hull and shows a side view of the vessel with ballast keel FIG. 7 shows a plan view of the vessel FIG. 8 shows a sailing vessel in which the stern part is divided into three separate sections, each operating independently of other sections and has lee boards port and starboard one each side to resist leeway, shows the vessel in side view FIG. 9 shows the vessel in plan view

DESCRIPTION OF PREFERRED EMBODIMENT

At the forward-most part of the stern of a buoyant hull, according to the invention, a rectangular plate 5 has its long axis arranged parallel with the fore/aft axis of buoyant hull and with its forward edge coincident with the forward most commencement of the said and that its aftmost edge is generally in the same athwartship plane as the aftmost waterline of the buoyant hull, such that when viewed athwartship the deepest part of the buoyant hull and the afore said rectangular plate 5 occupy the same depth below the water surface and that the upper surface of the said plate 5 is intimately attached to the upwardly extending fin 4 arranged along the first plate's fore/aft midline on its upper surface, such that the aftmost edge of combination plate with port and starboard longitudinal upstanding side walls 2 running the length of each said plate to then terminate aftwardly in the same athwartship plane as the afore-said base plate whilst the fin 4 is inclined forwardly downward to meet the fore/aft midline of the base plate 5 to which it joins, whilst the forward-most edge of the said combination plate are hinges 9 that extend forward to which both the said combination plate and hull are security attached, thereby allowing the said combination plate to hinge between horizontal and the artwardly upward surface of the buoyant hull, the up/down movement of the fin plate 4 occurs within a robust drop-board type housing 6 that is watertight to the buoyant hull and does not require additional attachment of the fin to the buoyant hull, the afore said hinge movement being controlled by suitable means, the simplicity of the afore described system reduces maintenance and has an established record of reliability.

1 Chine
2 Side walls
3 Transom of buoyant hull
4 The upstanding second flat rectangular plate that is a part of the combination plate
5 The first flat rectangular plate of the combination plate is a part of the whole combination plate
6 Upright slot, arranged parallel to for/aft axis of the hull, open aftwardly and at top and bottom
7 Recess in buoyant hull for combination plate—or a part thereof
8 Forward athwardship edge of combination plate
9 Hinges
10 Ballast keel
11 Deep central section of the hull
12 Slot and casing for upstanding second plate

The invention claimed is:

1. A boat hull comprising a bottom having a flat mid-section and a angled stern section that reduces in draft towards the stern of the boat, wherein a hydrodynamic appendage comprising a first flat rectangular plate is hingedly attached to the hull at the transition between the mid-section and the stern sections and extends towards the stern, the appendage has side walls extending upwardly from the first plate and an upwardly directed second rectangular flat plate arranged along a fore/aft axis of the first plate midway between the side walls to a height in excess of the said side walls, the second plate locating within an open slot casing that extends within the boat hull, wherein means are provided to raise and tower the hydrodynamic appendage, to pivotally move the first plate towards and away from the stern section.

2. A boat hull as claimed in claim 1 in which the stern part of the hull to comprise two or more similar sections as defined in claim 1 arranged parallel to the fore/aft axis and in line athwartships.

3. A boat hull as claimed in claim 1 or claim 2 where-in the said side walls of the appendage to be of a height to maintain the exclusion of water from outward of the hull.

* * * * *